US011643247B2

(12) United States Patent
Lantz et al.

(10) Patent No.: US 11,643,247 B2
(45) **Date of Patent: *May 9, 2023**

(54) WOODEN PALLET WITH BUTTED DECK BOARDS AND METAL BRACKET SUPPORTS

(71) Applicant: CHEP Technology Pty Limited, Sydney (AU)

(72) Inventors: Daniel J Lantz, Orlando, FL (US); Bart De Laender, Bruges (BE); Monika Milewska, Warsaw (PL)

(73) Assignee: CHEP TECHNOLOGY PTY LIMITED, Sidney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/815,606

(22) Filed: Jul. 28, 2022

(65) Prior Publication Data

US 2022/0363435 A1 Nov. 17, 2022

Related U.S. Application Data

(63) Continuation of application No. 16/515,164, filed on Jul. 18, 2019, now Pat. No. 11,401,073.
(Continued)

(51) Int. Cl.
*B65D 19/00* (2006.01)

(52) U.S. Cl.
CPC ..... *B65D 19/0071* (2013.01); *B65D 2519/00029* (2013.01); *B65D 2519/00094* (2013.01);
(Continued)

(58) Field of Classification Search
CPC ..... B65D 19/0071; B65D 2519/0029; B65D 2519/00094; B65D 2519/00104;
(Continued)

(56) References Cited

U.S. PATENT DOCUMENTS 2,503,022 A 4/1950 Benoist et al.
2,922,606 A 1/1960 Glassman et al.
(Continued)

FOREIGN PATENT DOCUMENTS

CN 1833958 9/2006
CN 101016094 8/2007
(Continued)

OTHER PUBLICATIONS

Official Notice of Rejection for Japanese Patent Application No. 2021-503758, dated Nov. 22, 2022, (9 pages), Japan Patent Office, Tokyo Japan.

*Primary Examiner* — Janet M Wilkens
*Assistant Examiner* — Timothy M Ayres
(74) *Attorney, Agent, or Firm* — Alston & Bird LLP

(57) ABSTRACT

A pallet includes a base layer, a cargo layer and spaced apart supports coupled between the base and cargo layers and forming a gap therebetween for receiving a lifting member. The supports include outer corner supports each configured as a C-shaped bracket, and center supports each configured as a circular-shaped cylinder. Each center support including an outer wall having opposing ends, a center hub having opposing ends, and ribs extending between the center hub and the outer wall.

19 Claims, 8 Drawing Sheets

Related U.S. Application Data

(60) Provisional application No. 62/702,430, filed on Jul. 24, 2018.

(52) U.S. Cl.
CPC ..... *B65D 2519/00104* (2013.01); *B65D 2519/00273* (2013.01); *B65D 2519/00293* (2013.01); *B65D 2519/00323* (2013.01); *B65D 2519/00373* (2013.01); *B65D 2519/00572* (2013.01)

(58) Field of Classification Search
CPC ..... B65D 2519/00273; B65D 2519/00293; B65D 2519/00323; B65D 2519/00373; B65D 2519/00572
USPC ..... 108/57.17
See application file for complete search history.

(56) References Cited

U.S. PATENT DOCUMENTS

| | | | | |
|---|---|---|---|---|
| 3,438,342 | A * | 4/1969 | Woolworth | B65D 19/0028 108/158 |
| 3,651,769 | A | 3/1972 | Foley | |
| 4,128,253 | A | 12/1978 | Powers | |
| 4,267,781 | A | 5/1981 | Powers | |
| 4,292,900 | A | 10/1981 | Bula | |
| 4,485,744 | A | 12/1984 | Umemura et al. | |
| 5,351,628 | A | 10/1994 | Breezer et al. | |
| 6,584,915 | B1 | 7/2003 | Rogers | |
| 8,261,673 | B2 | 9/2012 | Ingham | |
| 8,627,773 | B2 | 1/2014 | Storteboom et al. | |
| 8,667,905 | B2 | 3/2014 | Anderson et al. | |
| 9,032,884 | B2 | 5/2015 | Leen et al. | |
| 9,340,320 | B2 | 5/2016 | Brandt et al. | |
| 9,409,673 | B2 | 8/2016 | Brandt et al. | |
| 9,776,762 | B2 | 10/2017 | De Beer et al. | |
| 10,005,585 | B2 | 6/2018 | Brandt et al. | |
| 10,501,230 | B2 | 12/2019 | Lantz et al. | |
| 11,401,073 | B2 * | 8/2022 | Lantz | B65D 19/0071 |
| 2003/0075082 | A1 | 4/2003 | Apps | |
| 2005/0145145 | A1 | 7/2005 | Ogburn | |
| 2006/0005746 | A1 | 1/2006 | Gouldin, Jr. | |
| 2009/0320723 | A1 | 12/2009 | Low | |
| 2011/0005435 | A1 | 1/2011 | Renck et al. | |
| 2012/0260832 | A1 | 10/2012 | Linares | |
| 2015/0210425 | A1 | 7/2015 | Miller | |
| 2015/0360809 | A1 | 12/2015 | McBride et al. | |
| 2017/0275050 | A1 | 9/2017 | Pang | |
| 2018/0162588 | A1 | 6/2018 | Segerstrom | |

FOREIGN PATENT DOCUMENTS

| | | |
|---|---|---|
| CN | 202072066 | 12/2011 |
| CN | 103068688 | 4/2013 |
| CN | 203450523 | 2/2014 |
| CN | 204979552 | 1/2016 |
| CN | 106379627 | 2/2017 |
| CN | 107061454 | 8/2017 |
| CN | 206782303 | 12/2017 |
| DE | 9411879 | 1/1998 |
| DE | 202012005056 U1 | 8/2012 |
| DE | 202012009242 | 11/2012 |
| DE | 202013007560 | 10/2013 |
| EP | 0673845 | 9/1995 |
| EP | 1232952 | 8/2002 |
| EP | 2671815 | 12/2013 |
| EP | 3093250 | 11/2016 |
| GB | 2288783 | 11/1995 |
| JP | S48-12939 U | 4/1973 |
| JP | S50-150959 U | 12/1975 |
| JP | S58-17334 U | 2/1983 |
| JP | 2001278269 | 10/2001 |
| JP | 2009040436 | 2/2019 |
| WO | WO9113810 | 9/1991 |
| WO | WO 9743186 | 11/1997 |
| WO | WO2004106179 | 12/2004 |

* cited by examiner

WOODEN PALLET WITH BUTTED DECK BOARDS AND METAL BRACKET SUPPORTS

RELATED APPLICATION

This application is a continuation of application Ser. No. 16/515,164 filed Jul. 18, 2019 which claims the benefit of provisional application Ser. No. 62/702,430 filed Jul. 24, 2018, which are hereby incorporated herein in their entirety by reference.

TECHNICAL FIELD

The present disclosure relates to the field of pallets, and more particularly, to a wooden pallet having an improved resilience to impacts from material handling equipment.

BACKGROUND

Conventional wooden pallets include a base layer and a cargo layer separated by support blocks. The cargo layer traditionally has end deck boards assembled on connector boards that run the full length or width of the pallet. The end deck boards are nailed through the connector boards into the support blocks to build the primary structure of the pallet. The end deck boards are also known as lead boards. Intermediate deck boards are placed between the end deck boards.

To move the pallet with cargo thereon, forklift tines are inserted into the gaps between the base and cargo layers. If the forklift is not stopped in time, the forklift may crash into one of the end deck boards of the pallet. The end deck board may not be able to withstand such an impact over time. Accidents such as this weaken the pallet and greatly shorten the lifespan of the pallet, thereby causing the pallet to be repaired more frequently and/or removed from service long before its anticipated life cycle has been reached.

SUMMARY

A pallet includes a base layer, a cargo layer and a plurality of spaced apart supports coupled between the base and cargo layers and forming a gap therebetween for receiving a lifting member. The supports include outer corner supports each configured as a C-shaped bracket, and center supports each configured as a circular-shaped cylinder. Each center support includes an outer wall having opposing ends, a center hub having opposing ends, and a plurality of ribs extending between the center hub and the outer wall.

The opposing ends of the center wall may be aligned with the opposing ends of the outer wall.

The plurality of ribs may be recessed from opposing ends of the center hub and the outer wall.

The opposing ends of the outer wall may include a plurality of spaced apart drainage notches.

The plurality of ribs may be aligned with the plurality of spaced apart drainage notches.

The outer supports may comprise metal, and the center supports may comprise plastic.

The cargo layer may comprise a pair of spaced apart outer connector boards, at least one center connector board between the pair of outer connector boards, and a pair of spaced apart end deck boards on the pair of outer connector boards and the at least one center connector board. The end deck boards are orthogonal to the pair of outer connector boards and the at least one center connector board.

The cargo layer may further comprise a plurality of intermediate deck boards on the pair of outer connector boards and the at least one center connector board.

The base layer may comprise a pair of bottom end deck boards, and at least one bottom center deck board between the pair of bottom end deck boards.

The base and cargo layers may comprise wooden boards.

Another aspect is directed to a method for making a pallet as described above.

DETAILED DESCRIPTION

Figure 1:
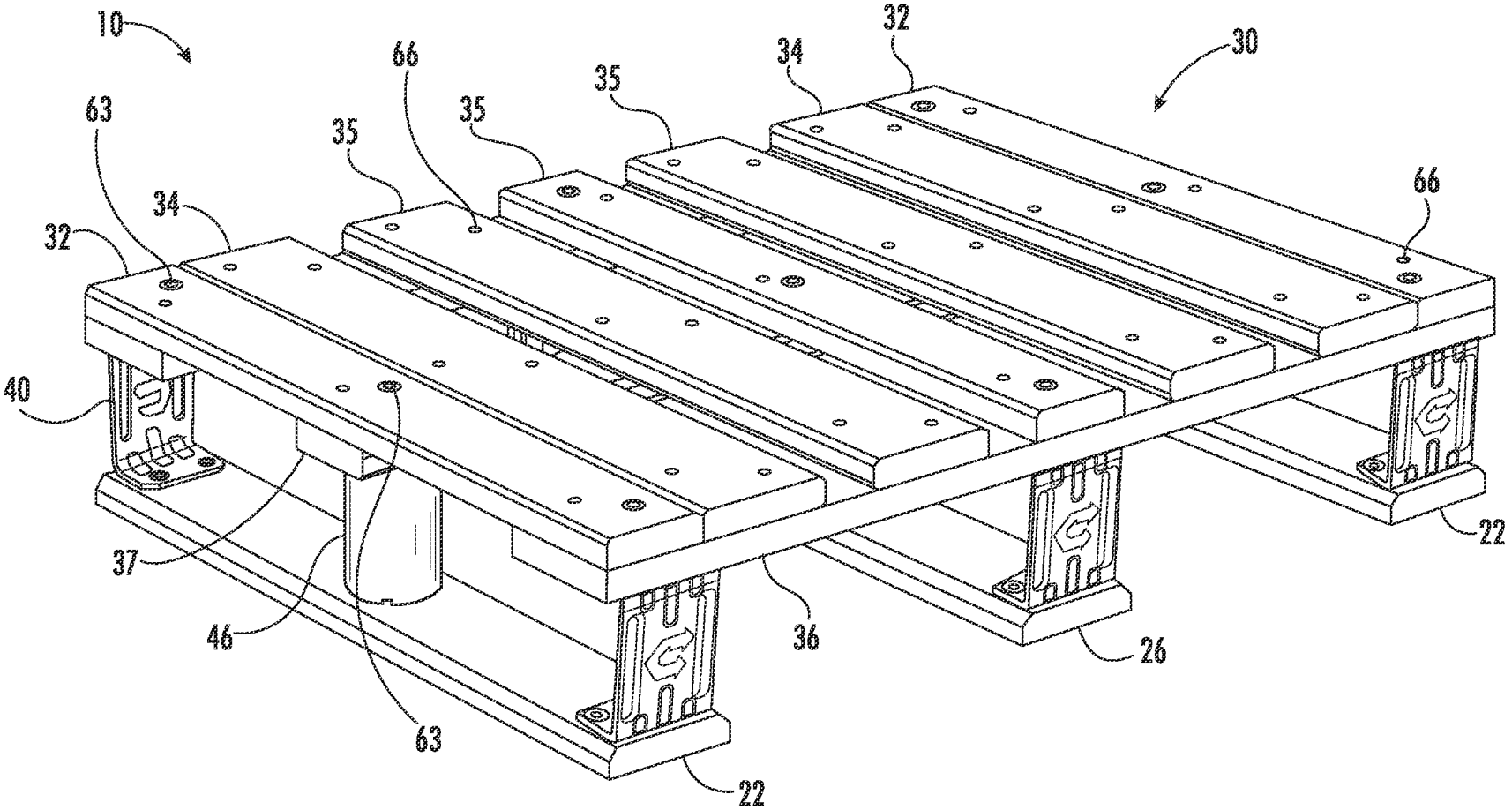
FIG. 1 is a top perspective view of a wooden pallet with butted deck boards in accordance with the disclosure.
Figure 2:
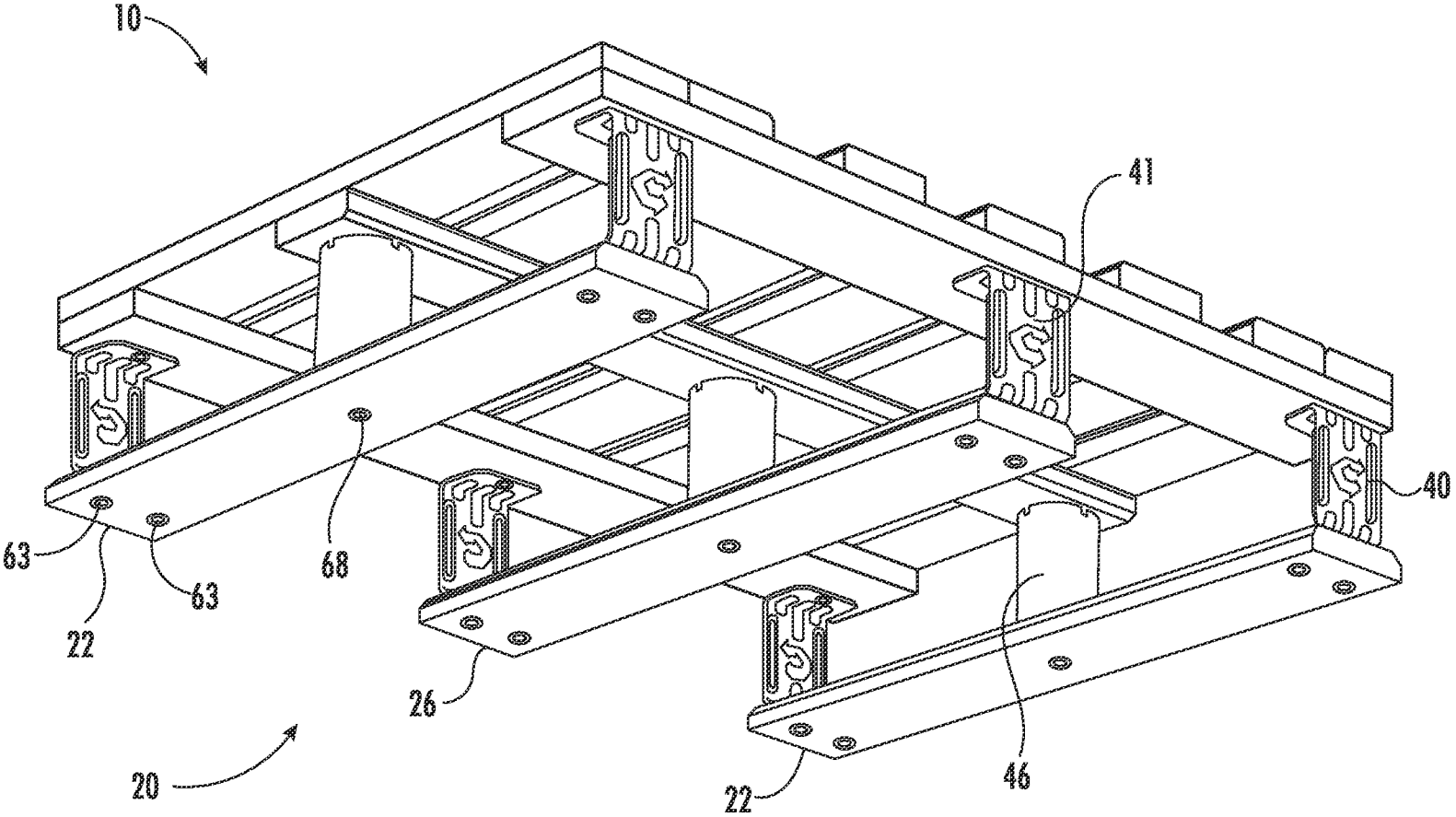
FIG. 2 is a bottom perspective view of the wooden pallet shown in FIG. 1.
Figure 3:
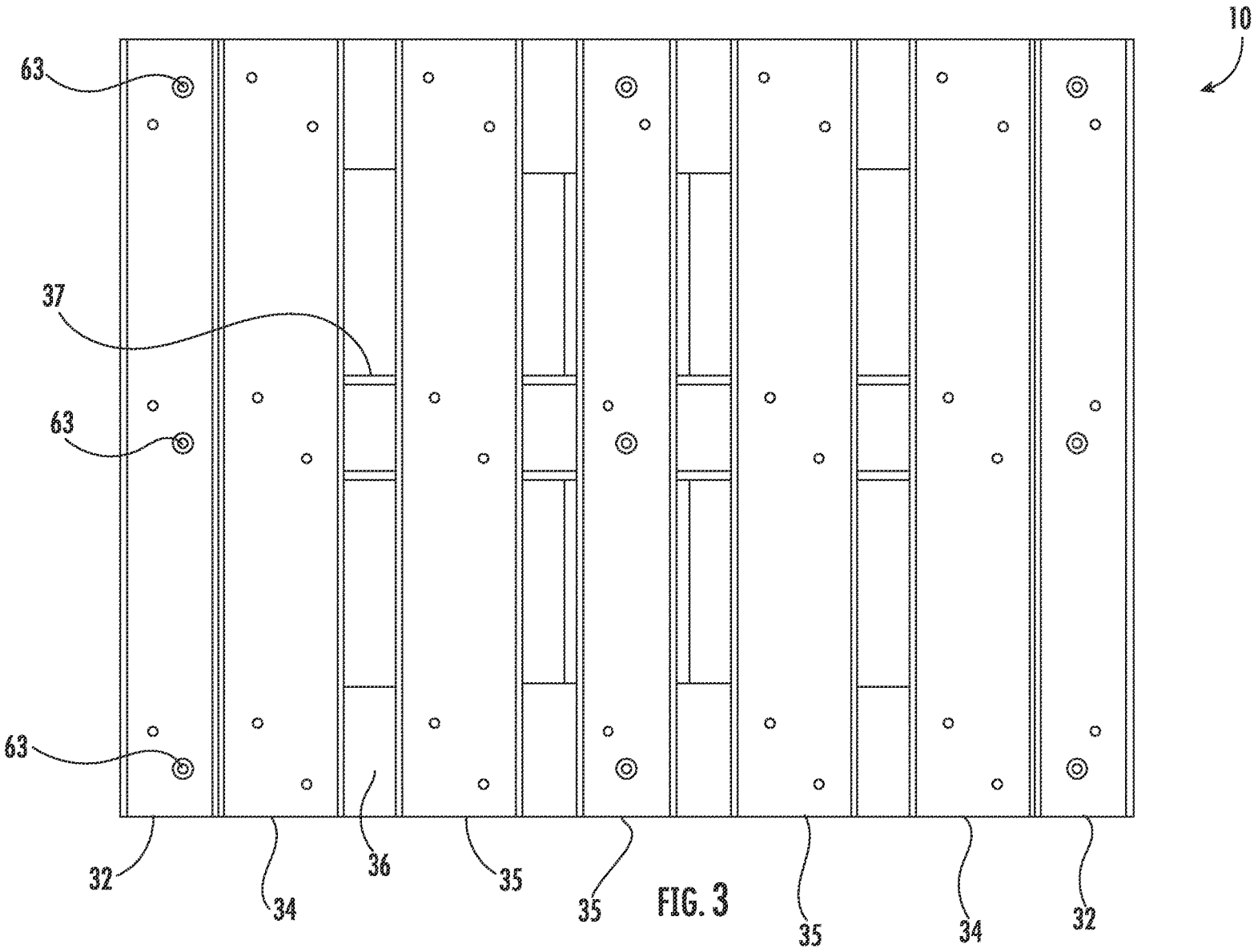
FIG. 3 is a top view of the wooden pallet shown in FIG. 1.
Figure 4:
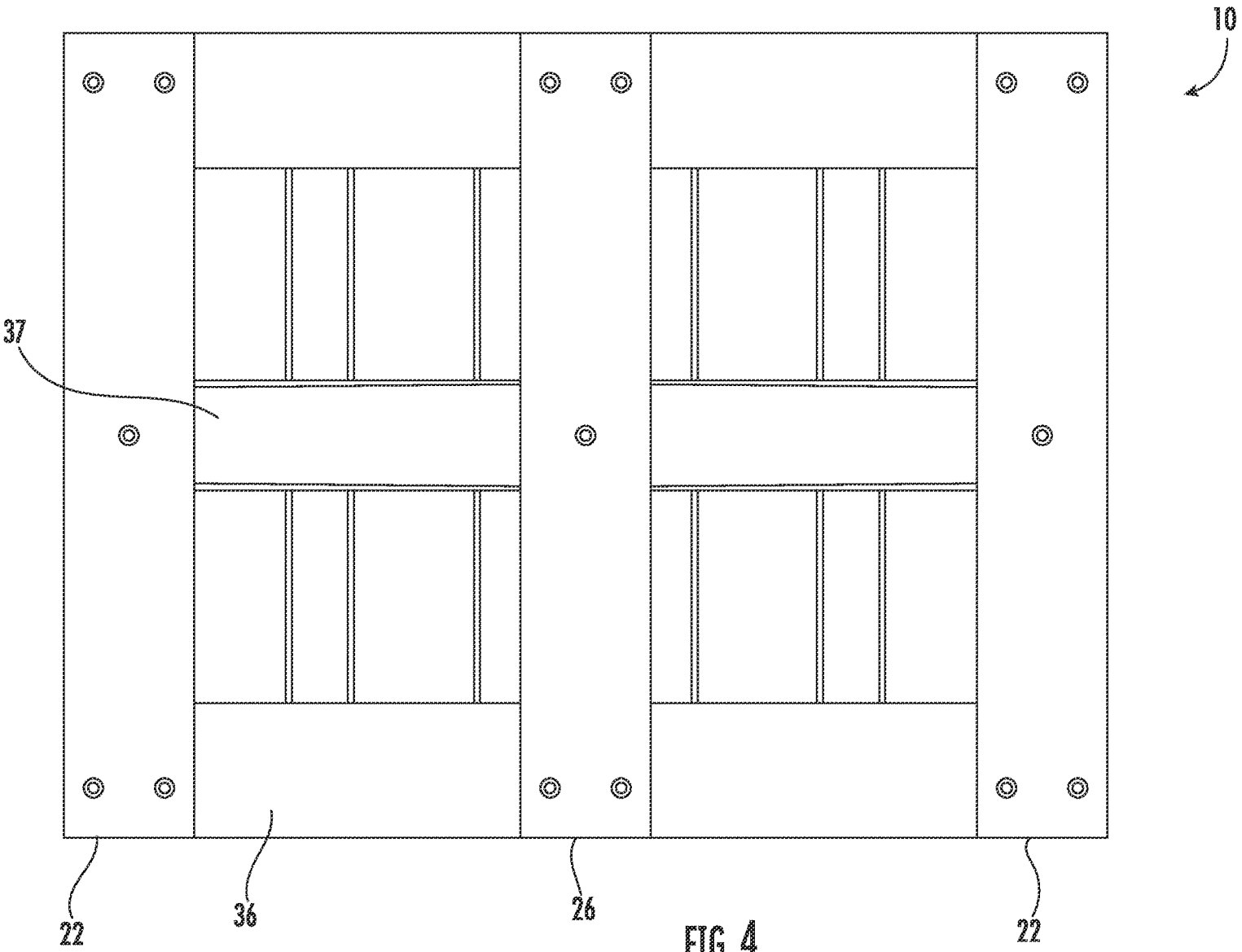
FIG. 4 is a bottom view of the wooden pallet shown in FIG. 1.
Figure 5:
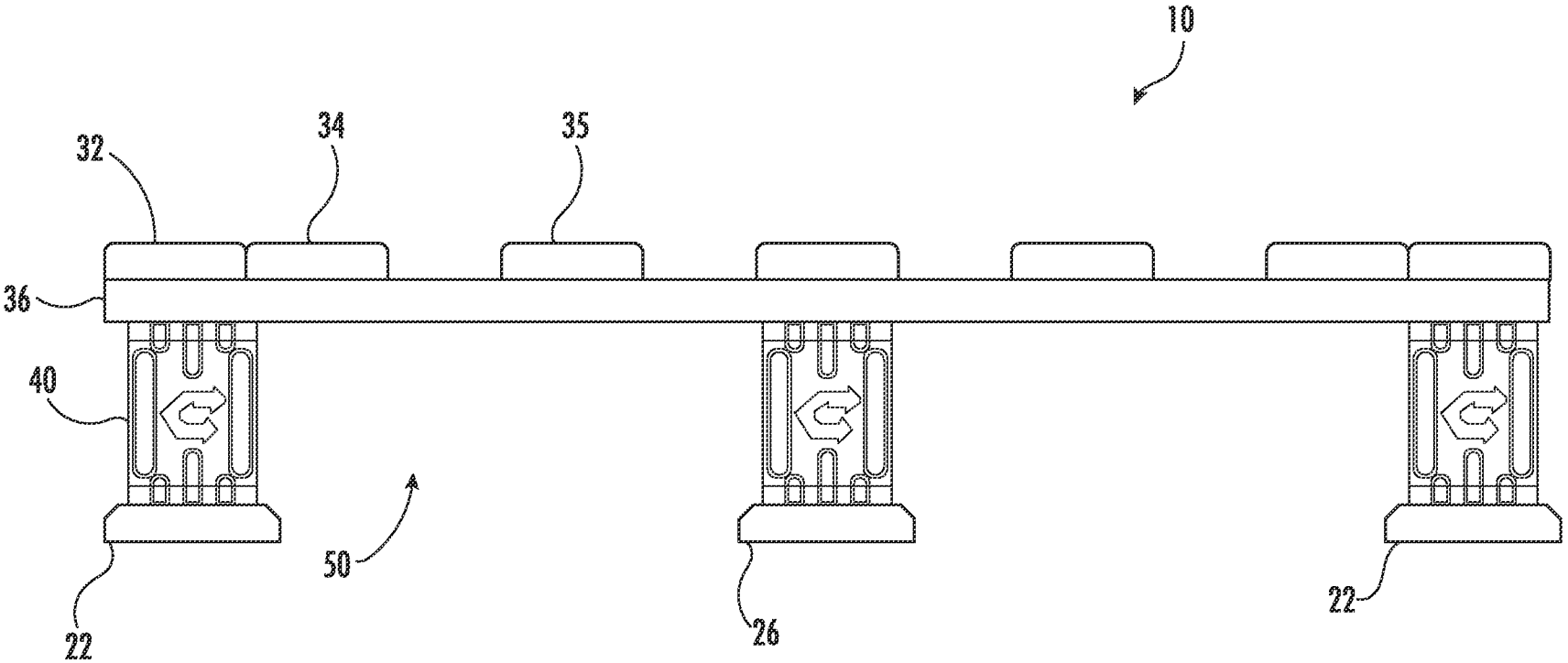
FIG. 5 is a side view of the wooden pallet shown in FIG. 1.
Figure 6:
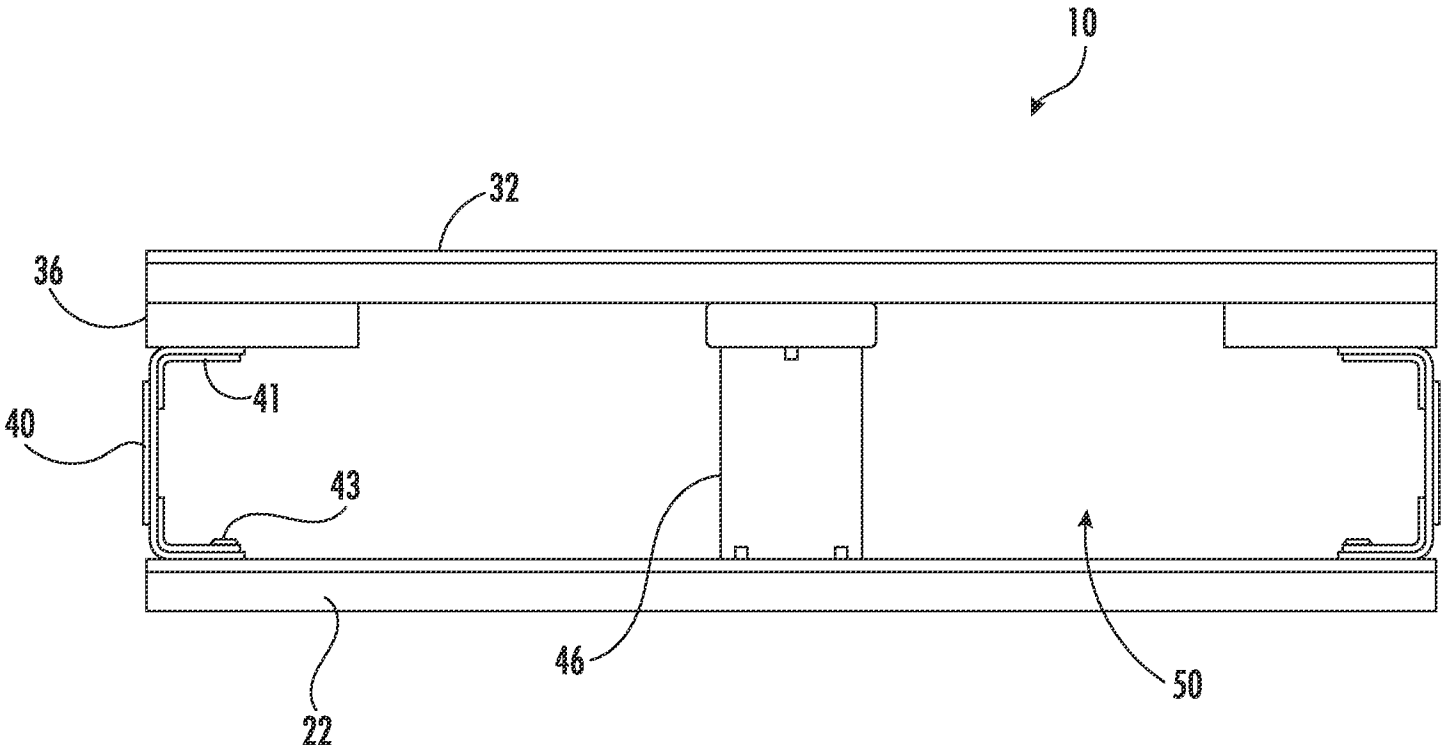
FIG. 6 is an end view of the wooden pallet shown in FIG. 1.

The present description is made with reference to the accompanying drawings, in which exemplary embodiments are shown. However, many different embodiments may be used, and thus the description should not be construed as limited to the particular embodiments set forth herein. Rather, these embodiments are provided so that this disclosure will be thorough and complete. Like numbers refer to like elements throughout.

Referring to FIGS. 1-6, the illustrated wooden pallet 10 includes a base layer 20, a cargo layer 30, and a plurality of supports 40, 46 coupled between the base and cargo layers. The supports 40, 46 form a gap 50 between the base and cargo layers 20, 30 for receiving a lifting member, such as fork lift tines.

The cargo layer 30 includes a pair of spaced apart wooden end deck boards 32, and a pair of wooden intermediate deck boards 34 between the end deck boards. More particularly, each end deck board 32 and an immediately adjacent intermediate deck board 34 are butted against one another. Pallet durability is significantly improved by having the end deck boards 32 butt up against the immediately adjacent intermediate deck boards 34.

Also included within the cargo layer 30 is a pair of spaced apart wooden connector boards 36 and a wooden intermediate connector board 37. The connector boards 36 and the intermediate connector board 37 are orthogonal to the end deck boards 32 and the intermediate deck boards 34. The end deck boards 32 and the intermediate deck boards 34 are positioned on the connector boards 36.

The base layer 20 includes bottom deck boards 22, 26 orientated in the same direction as the end deck boards 32 and the intermediate deck boards 34 in the cargo layer 30. The bottom deck boards 22, 26 are directly coupled to the supports 40, 46.

Figure 7:
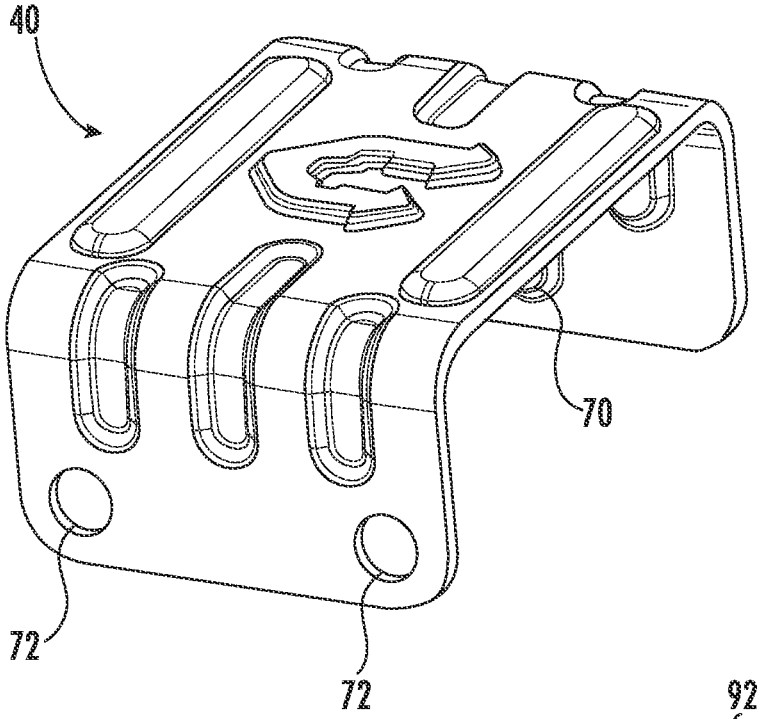
FIG. 7 is a perspective view of one of the metal bracket outer supports shown in FIG. 1.
Figure 8:
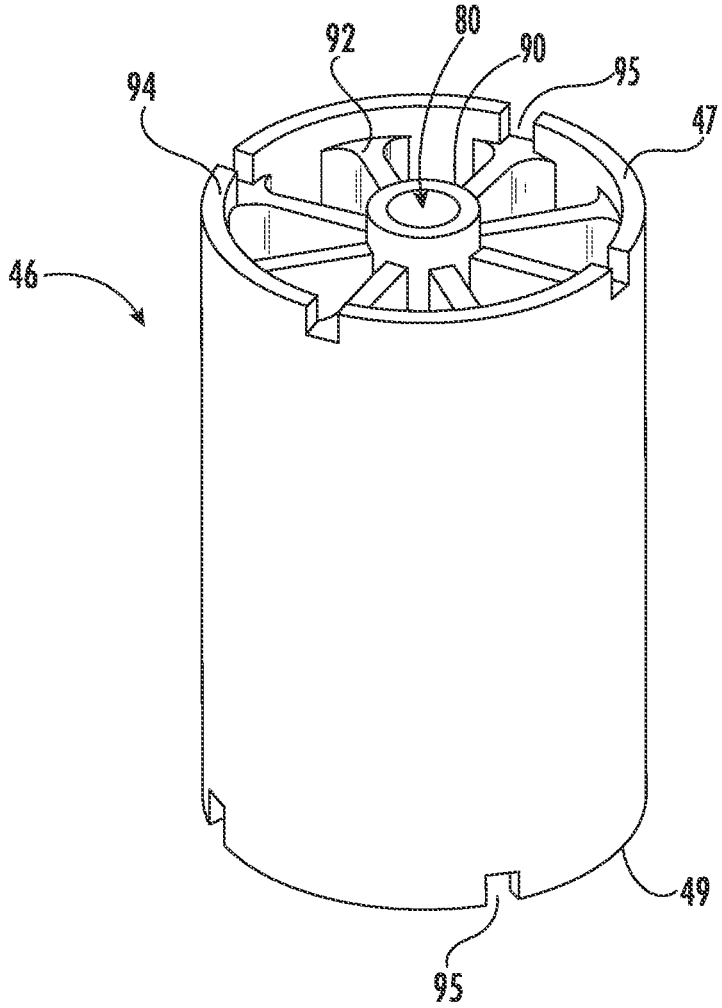
FIG. 8 is a perspective view of one of the plastic cylinder center supports shown in FIG. 1.

The supports include outer supports 40 and center supports 46 between the outer supports 40. The outer supports 40 are configured as metal brackets having a C-shape or U-shape as illustrated in FIG. 7. The center supports 46 are configured as circular-shaped plastic cylinders as illustrated in FIG. 8.

Bolts are used to secure the supports 40, 46 to the corresponding boards in the base and cargo layers 20, 30. A single respective bolt 63 is used for each support 40, 46 when securing to the cargo layer 30. For the base layer 20, a pair of respective bolts 63 is used for each outer support 40 and the same single respective bolt 63 is used for each center support 46 when securing to the base layer 20.

For the metal bracket outer supports 40, a single bolt opening 70 is in the cargo layer facing side, and a pair of bolt openings 72 is in the base layer facing side. For the plastic cylinder center supports 46, a single bolt opening 80 is in the cargo and base layer facing sides. The plastic cylinder center support 46 includes a center hub 90 that includes the bolt opening 80, and ribs 92 radially extending from the center hub 90 to an outer wall 94. The ribs 92 may be recessed from opposing ends 47, 49 of the center hub 90 and the outer wall 94. Notches or openings 95 are provided at the opposing ends 47, 49 to drain any liquids that may get inside of the plastic cylinder center support 46.

Figure 9:
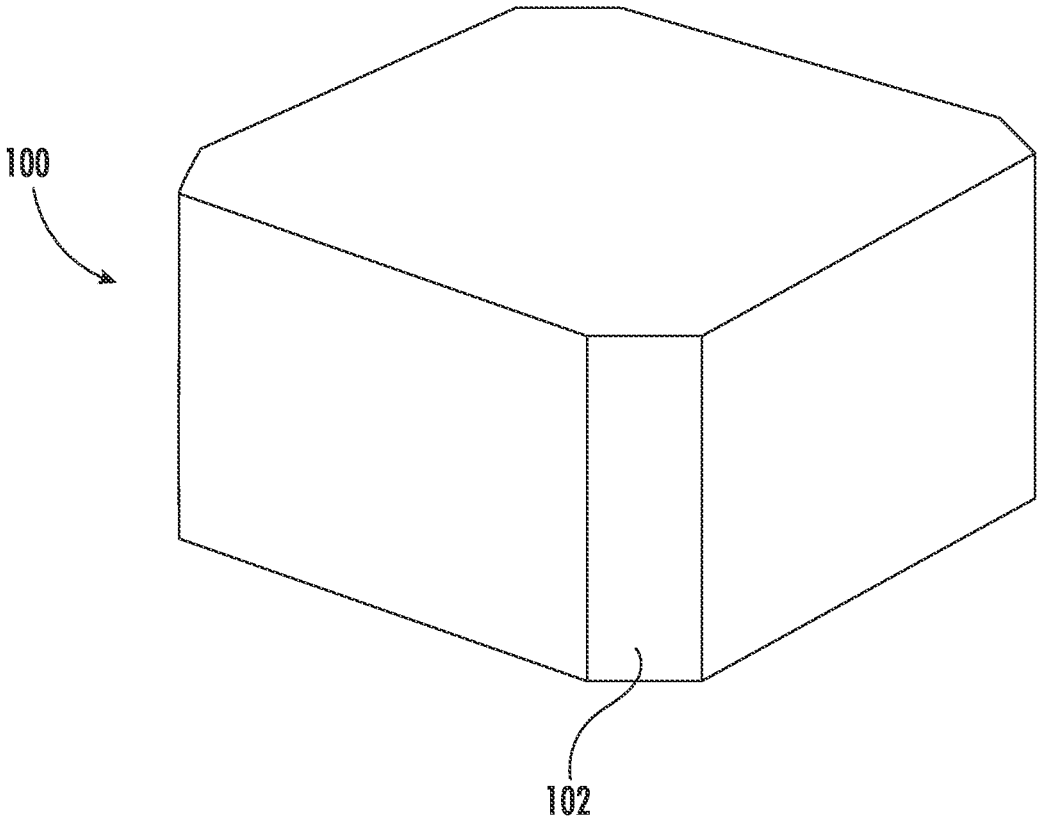
FIG. 9 is a perspective view of a wooden block support as an alternative to the supports shown in FIG. 1.

As an alternative to the metal bracket outer supports 40 and the plastic cylinder center support 46, wooden block supports 100 may be used as illustrated in FIG. 9. In other embodiments, wooden block supports 100 may be used to replace the outer supports 40 while the center supports 46 remain, or may be used to replace the center supports 46 while the outer supports 40 remain.

Nails 66 are used to couple adjacent boards together in the cargo layer 30. The nails 66 are used to secure the end deck boards 32, the intermediate deck boards 34 and additional intermediate deck boards 35 to the connector boards 36 and the intermediate connector board 37. The nails may be clinched nails, particularly in the butted intermediate deck boards 34.

The edges of each wooden support 100 may be angled or chamfered. The angled edges 102 may be within a range of about 25 to 75 degrees, for example, to deflect the impact force of the forklift tines should such an impact occur. The illustrated edges are angled at 45 degrees.

In the illustrated wooden pallet 10, a size of each end deck board 32 and a corresponding intermediate deck board 34 butted thereagainst have the same dimensions. For example, a width of the end deck board 32 and the intermediate deck board 34 butted thereagainst may be 145 mm, for example. In another example, the width may be 78 mm.

In other embodiments, the size of each end deck board 32 and a corresponding intermediate deck board 34 have different dimensions. For example, the width of the end deck board 32 may be 78 mm and the width of the corresponding intermediate deck board 34 may be 98 mm.

Traditionally, the intermediate deck boards in wooden pallets have a width that is less than a width of the end deck boards. In addition, traditionally there is a gap between the end deck boards and the adjacent intermediate deck boards. In the illustrated wooden pallet 10, pallet durability is significantly improved when there is no gap between the end deck boards 32 and the immediately adjacent intermediate deck boards 34, particularly with the end deck boards 32 and the immediately adjacent intermediate deck boards 34 having a same width.

The cargo layer 30 also includes at least one additional intermediate deck board 35 positioned between the intermediate deck boards 34 that are butted against the end deck boards 32. The additional intermediate deck boards 35 are positioned so that there is a gap between the adjacent intermediate deck boards 34. The dimensions of the end deck boards 32 and the intermediate deck boards 34 as well as additional intermediate deck boards 35 positioned between the intermediate deck boards 34 are selected and spaced such that coverage of the cargo layer 30 is within a range of 70-85 percent of a maximum total surface area of the cargo layer 30 when there are no gaps between the boards.

A width of the intermediate deck boards 35 may be the same as a width of the intermediate deck boards 34 butted against the end deck boards 32. Alternatively, in other embodiments, the intermediate deck boards 35 may have different widths. In addition, the boards making up the intermediate deck boards 35 may have different widths. For example, one of the intermediate deck boards 35 may have a width of 98 mm and another one of the intermediate deck boards 35 may have a width of 78 mm.

Another aspect is directed to a method for making a pallet 10 as described above. The method includes providing a base layer 20, and providing a cargo layer 30. The cargo layer 30 includes a pair of spaced apart outer connector boards 36, and at least one center connector board 37 between the pair of outer connector boards 36. A pair of spaced apart end deck boards 32 is on the pair of outer connector boards 36 and the at least one center connector board 37, with the end deck boards 32 being orthogonal to the outer connector boards 36 and the at least one center connector board 37. A pair of spaced apart intermediate deck boards 34 is on the pair of connector boards 36 and the at least one center connector board 37, with the intermediate deck boards 34 being orthogonal to the outer connector boards 36 and the at least one center connector board 37 and butted against a respective end deck board 32.

The spaced apart supports are coupled between the base and cargo layers 20, 30. The supports include outer supports 40 and center supports 46. The outer supports 40 are configured as a C-shaped bracket having an upper flange 41 contacting one of the outer connector boards 36 and a bottom flange 43 contacting the base layer 20. The center supports 46 are configured as a circular-shaped cylinder having an upper surface 47 contacting the at least one center connector board 37 and a bottom surface 49 contacting the base layer 20.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A pallet comprising:

a base layer;

a cargo layer; and a plurality of spaced apart supports coupled between said base and cargo layers and forming a gap therebetween for receiving a lifting member, and comprising:

outer corner supports each configured as a C-shaped bracket, and center supports each configured as a circular-shaped cylinder and comprising:

an outer wall having opposing ends that include a plurality of spaced apart drainage notches, a center hub having opposing ends, and a plurality of ribs extending between said center hub and said outer wall.

2. The pallet according to claim 1 wherein the opposing ends of said center wall are aligned with the opposing ends of said outer wall.

3. The pallet according to claim 1 wherein said plurality of ribs are recessed from opposing ends of said center hub and said outer wall.

4. The pallet according to claim 1 wherein said plurality of ribs are aligned with the plurality of spaced apart drainage notches.

5. The pallet according to claim 1 wherein said outer supports comprise metal.

6. The pallet according to claim 1 wherein said center supports comprise plastic.

7. The pallet according to claim 1 wherein said cargo layer comprises:

a pair of spaced apart outer connector boards;

at least one center connector board between said pair of outer connector boards; and a pair of spaced apart end deck boards on said pair of outer connector boards and said at least one center connector board, with said end deck boards being orthogonal to said pair of outer connector boards and said at least one center connector board.

8. The pallet according to claim 7 wherein said cargo layer further comprises a plurality of intermediate deck boards on said pair of outer connector boards and said at least one center connector board.

9. The pallet according to claim 1 wherein said base layer comprises a pair of bottom end deck boards, and at least one bottom center deck board between said pair of bottom end deck boards.

10. The pallet according to claim 1 wherein said base and cargo layers comprise wooden boards.

11. A method for making a pallet comprising:

forming a base layer;

forming a cargo layer; and coupling a plurality of spaced apart supports between the base and cargo layers and forming a gap therebetween for receiving a lifting member, and comprising:

outer corner supports each configured as a C-shaped bracket, and center supports each configured as a circular-shaped cylinder and comprising:

an outer wall having opposing ends that include a plurality of spaced apart drainage notches, a center hub having opposing ends, and a plurality of ribs extending between said center hub and said outer wall.

12. The method according to claim 11 wherein the opposing ends of the center wall are aligned with the opposing ends of the outer wall.

13. The method according to claim 11 wherein the plurality of ribs are recessed from opposing ends of the center hub and the outer wall.

14. The method according to claim 11 wherein the plurality of ribs are aligned with the plurality of spaced apart drainage notches.

15. The method according to claim 11 wherein the outer supports comprise metal.

16. The method according to claim 11 wherein the center supports comprise plastic.

17. The method according to claim 11 wherein the cargo layer comprises:

a pair of spaced apart outer connector boards;

at least one center connector board between the pair of outer connector boards; and a pair of spaced apart end deck boards on the pair of outer connector boards and the at least one center connector board, with the end deck boards being orthogonal to the pair of outer connector boards and the at least one center connector board.

18. The method according to claim 11 wherein the base layer comprises a pair of bottom end deck boards, and at least one bottom center deck board between the pair of bottom end deck boards.

19. A pallet comprising:

a base layer;

a cargo layer; and a plurality of spaced apart supports coupled between said base and cargo layers and forming a gap therebetween for receiving a lifting member, the plurality of spaced apart supports comprising:

outer corner supports each configured as a C-shaped bracket, and center supports each configured as a circular-shaped cylinder and comprising:

an outer wall having opposing ends, a center hub having opposing ends, and a plurality of ribs extending between said center hub and said outer wall and recessed from the opposing ends of said center hub and the opposing ends of said outer wall.

* * * * *